US006298755B1

(12) United States Patent
England

(10) Patent No.: US 6,298,755 B1
(45) Date of Patent: Oct. 9, 2001

(54) DIMPLER TOOL

(76) Inventor: Mark A. England, 768 N. 750 W, Clearfield, UT (US) 84015

( * ) Notice: Subject to any disclaimer, the term of this patent is extended or adjusted under 35 U.S.C. 154(b) by 0 days.

(21) Appl. No.: 09/665,009

(22) Filed: Sep. 19, 2000

(51) Int. Cl.[7] ..... B25B 23/00

(52) U.S. Cl. ..... 81/438; 81/439; 81/177.4; 81/490; 7/105

(58) Field of Search ..... 81/436, 438, 439, 81/441, 177.4, 490; 7/105; D8/45

(56) References Cited

U.S. PATENT DOCUMENTS

| | | | | |
|---|---|---|---|---|
| D. 328,228 | * | 7/1992 | Rokita | D8/89 |
| 3,879,848 | | 4/1975 | Murphy . | |
| 4,041,558 | | 8/1977 | Victor . | |
| 4,355,466 | | 10/1982 | Quiring . | |
| 4,658,457 | | 4/1987 | Rokita . | |
| 4,776,568 | | 10/1988 | Perel . | |
| 4,982,632 | * | 1/1991 | Barmore | 81/438 |
| 5,546,625 | | 8/1996 | Mealey, Sr. . | |
| 5,720,063 | | 2/1998 | Chacon . | |
| 5,868,048 | * | 2/1999 | Cassutti et al. | 81/439 |

* cited by examiner

*Primary Examiner*—James G. Smith
*Assistant Examiner*—Joni B. Danganan
(74) *Attorney, Agent, or Firm*—Dale J. Ream

(57) ABSTRACT

A dimpler tool comprises a handle member having a side wall, a closed bottom, and an open top defining an interior space. The dimpler tool further includes a lid threadably coupled to the handle member so as to removably cover the open top. A first portion of a shaft is embedded in the closed bottom of the handle member and a second portion of the shaft projects from the bottom and is normal thereto. A dimpler attachment is removably coupled to the second portion of the shaft and includes a tip that tapers to a point. The tip may be inserted into a hole left in a wall as a result of removal of a fastener, the hole being smoothed over by a rotational pressure applied to the dimpler tool by a user. The dimpler attachment is interchangeable with attachments having variously sized tips or with auxiliary attachments having variously configured screwdriver tips.

7 Claims, 10 Drawing Sheets

DIMPLER TOOL

BACKGROUND OF THE INVENTION

This invention relates generally to hand tools for forming a smooth spackle receiving cavity at a wall location where a fastener has been removed and, more particularly, to a dimpler tool having interchangeable attachments for forming a smooth spackle receiving cavity or driving a fastener into the wall.

In fastening sheetrock panels to walls, it is often the case that a fastener, such as a nail or screw, is incorrectly positioned such that the fastener does not engage a stud or beam. Missing the stud may occur where the studs are not spaced apart at expected intervals, such as 16-inch centers, in pre-existing structures being renovated, or in uniquely designed wall areas. In these circumstances, the mistakenly positioned fastener may be removed such as with the claw of a hammer or with a screwdriver, as the case may be. However, fastener removal often results in a hole that is rough and may include torn sheetrock paper which needs to be smoothed with spackling prior to painting of the wall.

Various devices have been proposed in the art for forming a smooth cavity at the position where a fastener was removed from a wall. Although assumably effective for their intended purpose, existing devices do not provide for the interchangeability of dimpler tips of various sizes and configurations or for storage of these tips within the tool itself.

Therefore, it is desirable to have a dimpler tool in which tips of various sizes may be interchangeably coupled thereto. Further, it is desirable to have a dimpler tool in which auxiliary attachments having screwdriver tips may also be removably coupled to the tool. Finally, it is desirable to have a dimpler tool in which all of the interchangeable attachments may be stored within a chamber defined by the tool.

SUMMARY OF THE INVENTION

A dimpler tool according to the present invention includes a handle member having a cylindrical side wall, a closed bottom, and an open top which define an interior chamber. A lid is threadably coupled to the handle member so as to removably cover the open top and selectively enclose the chamber. A shaft includes a first portion fixedly embedded in the closed bottom of the handle member and a second portion projecting therefrom and normal to the closed bottom. A dimpler attachment is removably coupled to the second portion extending from the handle member. The dimpler attachment may be coupled to the shaft by way of complementary threaded configurations, a socket-like snap-fit configuration, or with screws. The dimpler attachment includes a generally cylindrical configuration having a tip that is tapered to a point at a free end thereof. In use, this tip may be positioned in a hole created by the removal of a fastener. Then, a gentle pushing and twisting force may be exerted against the tool for pushing stray sheetrock paper into the hole and forming a smooth cavity for receiving spackling.

The dimpler tool also includes a plurality of auxiliary attachments each having a screwdriver tip. Each screwdriver tip may include a square head bit, Phillips head bit, hex-head bit, a torque bit, or any other bit configuration. The auxiliary attachments are advantageous where a fastener merely needs to be further driven into a wall surface rather than removed therefrom. The auxiliary tips also make the dimpler tool suitable for other applications where a screwdriver is typically used. When not in use, the dimpler attachment or auxiliary attachments may be stored within the chamber.

Therefore, a general object of this invention is to provide a dimpler tool which is useful to repair holes in sheetrock caused by the removal of a fastener therefrom.

Another object of this invention is to provide a dimpler tool, as aforesaid, which forms a smooth spackle receiving cavity at the hole location.

Still another object of this invention is to provide a dimpler tool, as aforesaid, in which variously sized dimpler attachments are interchangeably attachable to a handle member.

Yet another object of this invention is to provide a dimpler tool, as aforesaid, in which variously configured screwdriver tips are interchangeably attachable to the handle member.

A further object of this invention is to provide a dimpler tool, as aforesaid, which can store a plurality of interchangeable tips within a chamber defined by the handle member.

A still further object of this invention is to provide a dimpler tool, as aforesaid, which is easy to grip during use.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
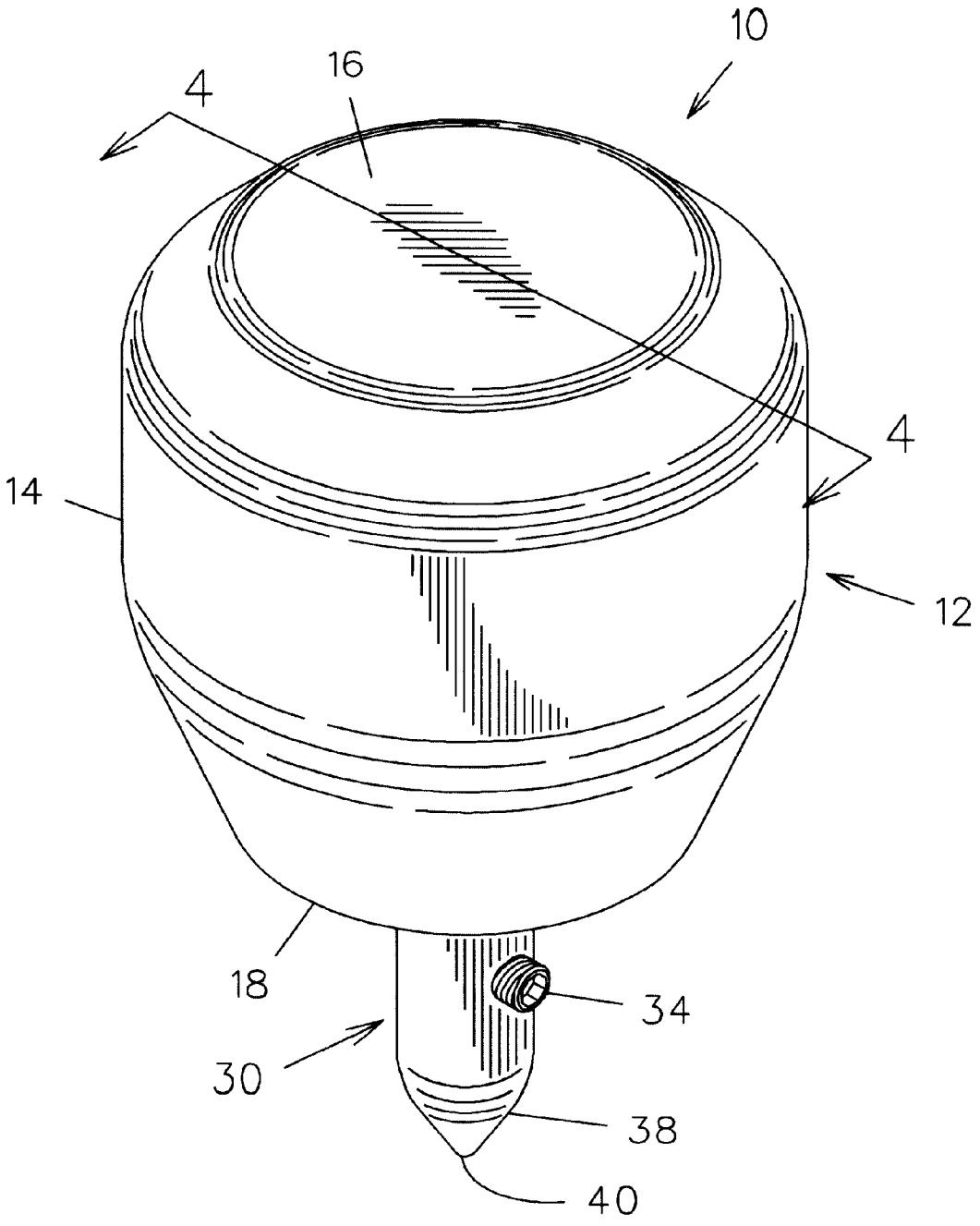
FIG. 1 is a perspective view of an embodiment of a dimpler tool according to the present invention.
Figure 2:
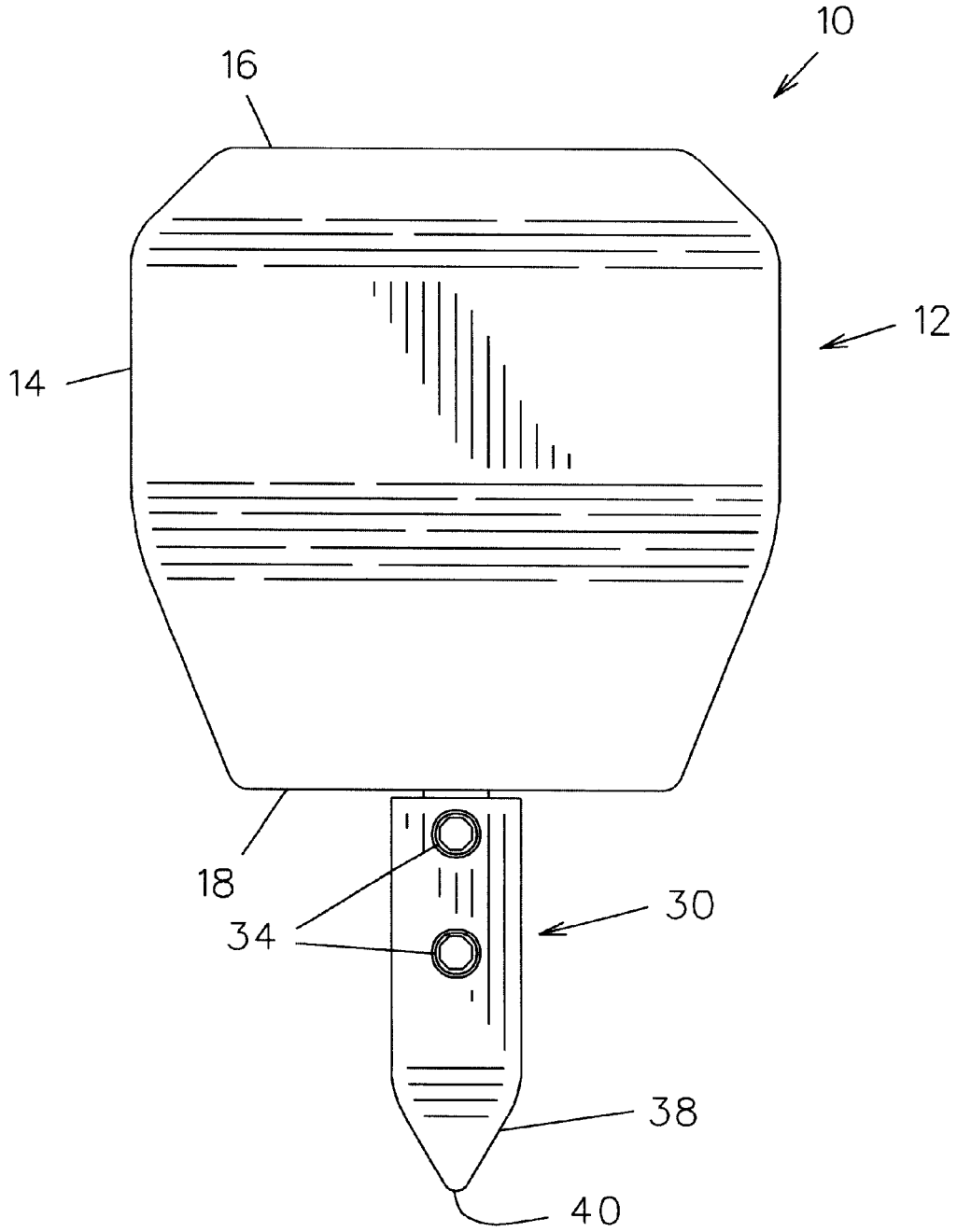
FIG. 2 is a front view of the dimpler tool as in FIG. 1.
Figure 3:
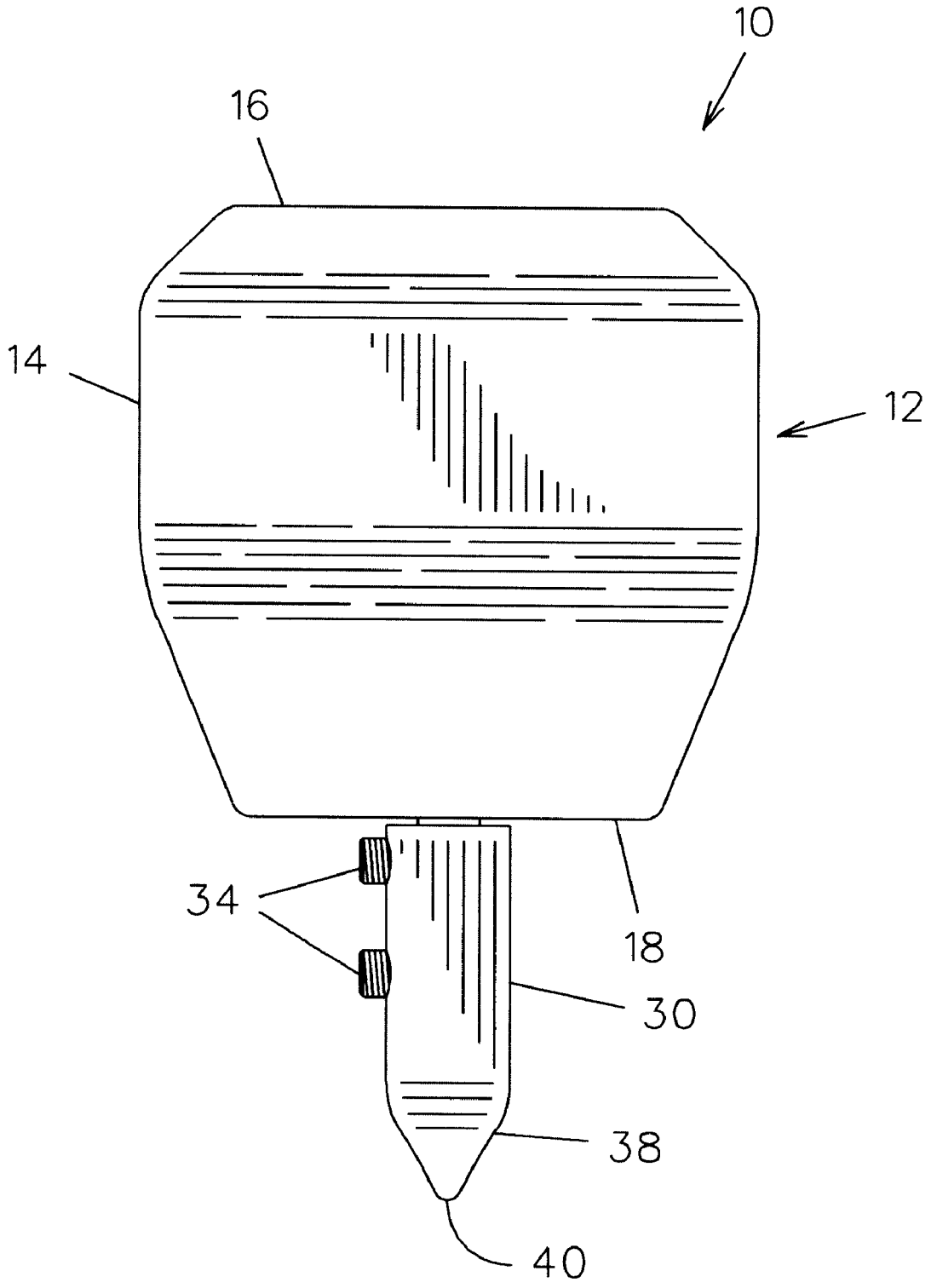
FIG. 3 is a side view of the dimpler tool as in FIG. 1.

The dimpler tool according to a preferred embodiment of the present invention will now be described with reference to FIGS. 1–10 of the accompanying drawings. As shown particularly in FIGS. 1–4, one embodiment of a dimpler tool 10 includes a body portion in the form of a bulbous handle member 12. The handle member 12 includes a generally cylindrical configuration having a side wall 14 intermediate top 16 and bottom 18 wall, the top wall 16 having a diameter larger than a diameter of the bottom wall 18. The top 16 and bottom 18 walls are parallel to each other, the top wall 16 presenting a flat surface against which a user may apply pressure or even impact force, as to be more fully described below. The handle member 12 is of solid wood construction although a rigid plastic material would also be suitable.

Figure 4:
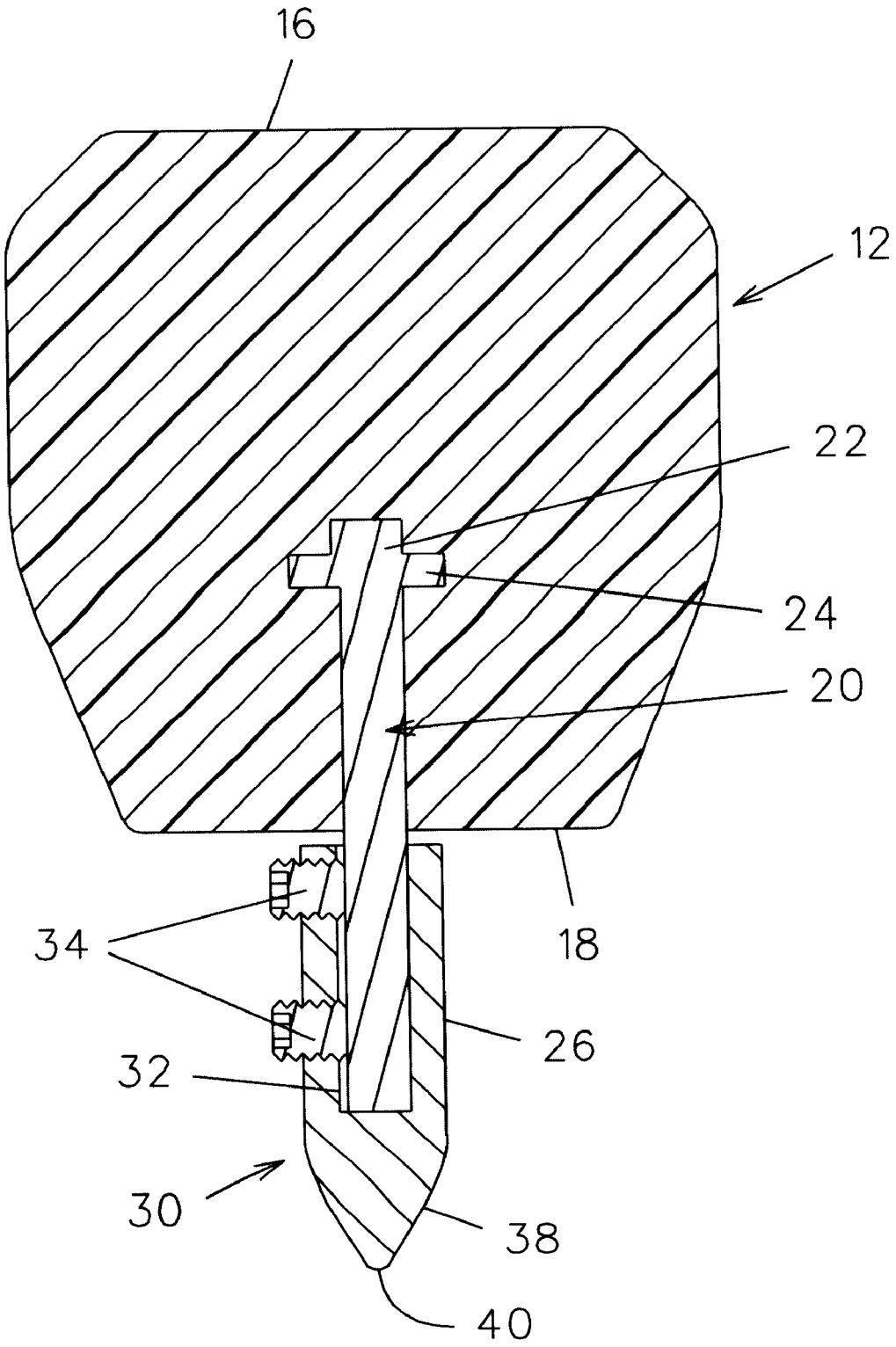
FIG. 4 is a sectional view of the dimpler tool taken along line 4—4 of FIG. 1.

The dimpler tool 10 further includes a generally cylindrical rod or shaft 20 having a first portion 22 embedded in the handle member 12 and a second portion 26 projecting from the bottom wall 18 and being normal thereto (FIG. 4). The first portion 22 includes a flange 24 normal to the shaft 20 for inhibiting unintended removal of the shaft 20 from the handle member 12. The shaft 20 is constructed of stainless steel although a rigid plastic material would be suitable as well.

Figure 5:
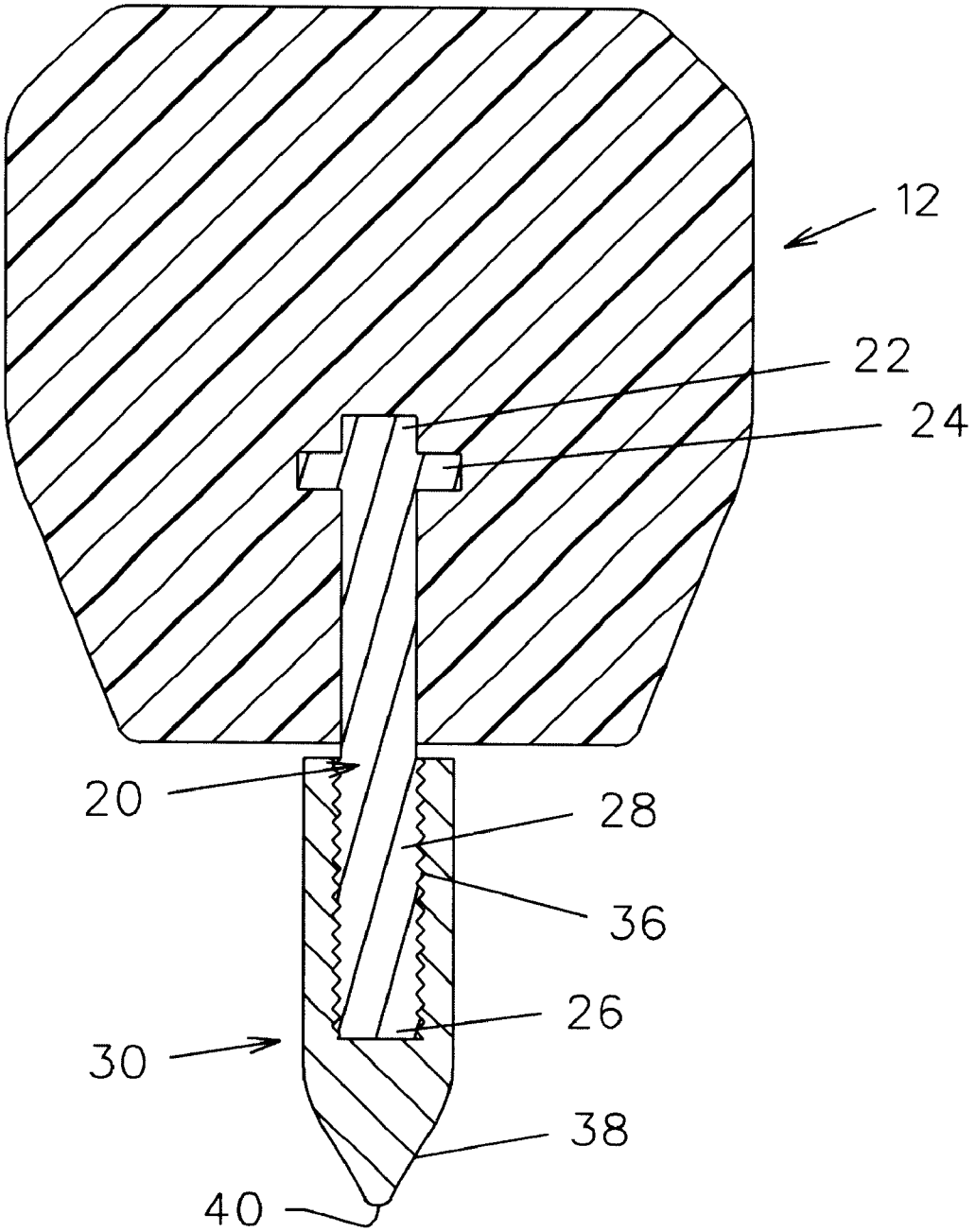
FIG. 5 is a sectional view as in FIG. 4 illustrating a threaded configuration for attaching a dimpler attachment to the dimpler tool.

The dimpler tool 10 also includes a dimpler attachment 30 configured for removable attachment to the shaft 20. The dimpler attachment includes a generally cylindrical configuration defining a cylindrical interior cavity 32 that is open at one end. The cavity 32 presents a diameter slightly larger than a diameter of the shaft 20 so that the second portion 26 thereof may be inserted into the cavity 32. The dimpler attachment 30 includes a pair of spaced apart Allen screws 34 which, when tightened with an Allen wrench, bear against the second portion 26 of the shaft 20 so as to releasably couple the dimpler attachment 30 thereto (FIG. 4). Obviously, other types of screws may be used in a similar manner. Alternatively, the inner surface of the cavity 32 and the second portion 26 of the shaft 20 may include threads 36, 28, respectively, that are complementary to each other such that the dimpler attachment 30 may be threadably coupled to the shaft 20 (FIG. 5). Another attachment alternative is that the cavity 32 and second portion 26 may be configured to be coupled in a snap-fit relationship similar to socket/wrench sets. The dimpler attachment includes a cylindrical tip 38 which tapers by way of decreasing diameter to a point 40 at a free end opposite the open end. It is understood that dimpler attachments having variously sized tips may be included with the dimpler tool 10 for forming smooth cavities according to the diameter of a hole caused by a removed fastener.

Figures 6A, 6B, 6C, 6D:
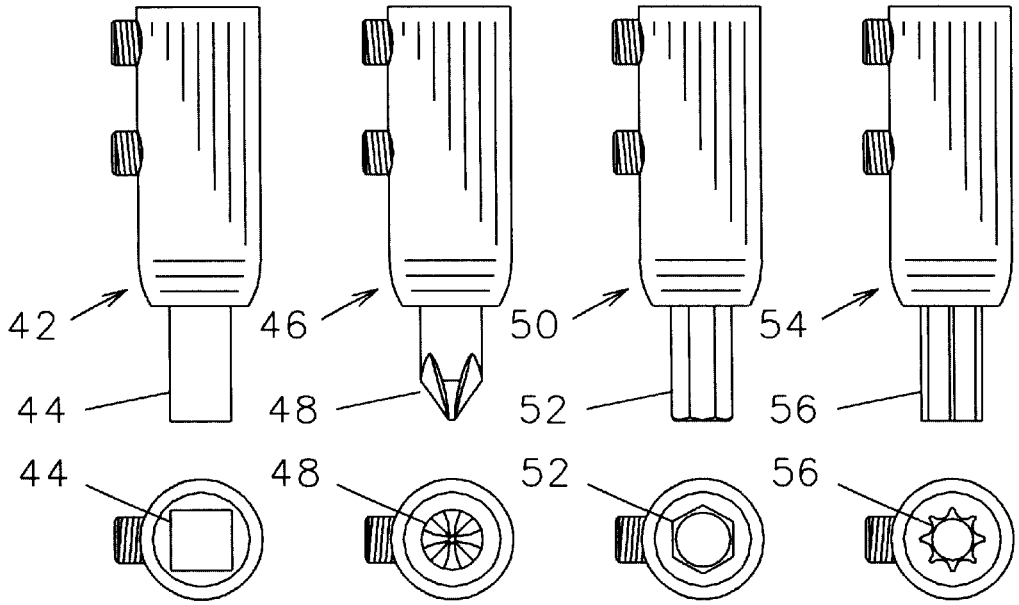
FIG. 6*a* is a side and end view of an auxiliary screwdriver attachment having square head bit.
FIG. 6*b* is a side and end view of an auxiliary screwdriver attachment having a Phillips head bit.
FIG. 6*c* is a side and end view of an auxiliary screwdriver attachment having a hexagonal head bit.
FIG. 6*d* is a side and end view of an auxiliary screwdriver attachment having a torque head bit.

A plurality of variously configured auxiliary attachments are also provided for use with the dimpler tool 10 (FIG. 6). Each auxiliary attachment is constructed in a manner substantially similar to the dimpler attachment 30 except as specifically noted below. In other words, each auxiliary attachment defines a cavity having an open top and a diameter sufficient such that the shaft 20 may be inserted therein. Further, each auxiliary attachment may be removably coupled to the second portion 26 of the shaft 20 with complementary threads, with screws, or with a snap-fit configuration as described above. One auxiliary attachment 42 includes a screwdriver tip having a square head bit 44. The screwdriver tip of another auxiliary attachment 46 includes a Phillips head bit 48. Screwdriver tips of other auxiliary attachments 50, 54 include hexagonal 52 and torque or star bits 56, respectively.

Figure 7:
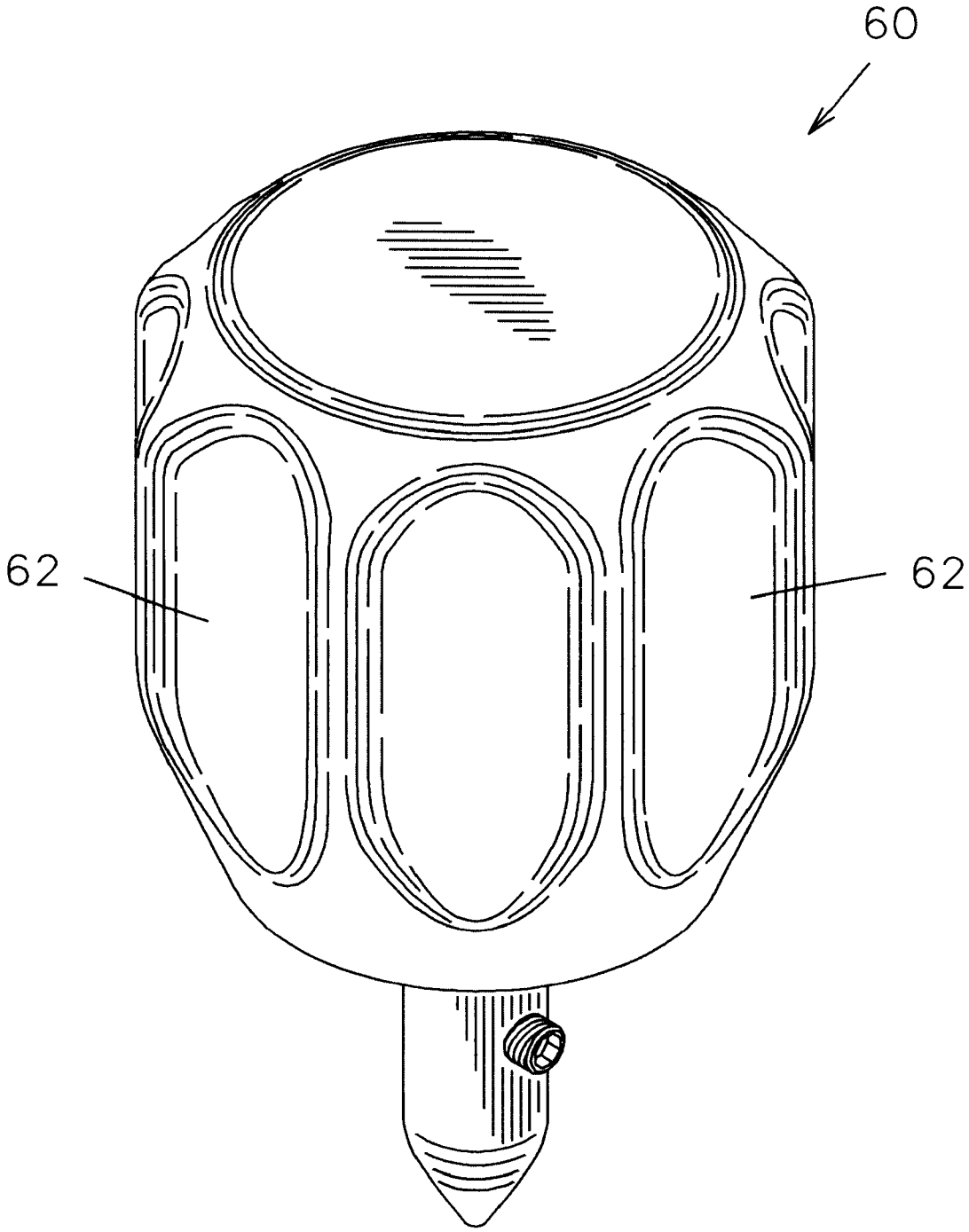
FIG. 7 is a perspective view of another embodiment of the dimpler tool.

Another embodiment of the dimpler tool, denoted in FIG. 7 by reference number 60, is constructed in a manner substantially similar as described above except as specifically noted below. This embodiment 60 includes a plurality of grooves or recesses 62 to enable the tool to be better gripped by a user. Each recess 62 extends substantially between top 16 and bottom 18 walls of the handle member 12 and defines a width sufficient to receive at least one of a user's fingers therein. The recesses are laterally adjacent one another and may be integrally formed in the handle member 12 or in a rubber cover that slips over the handle member 12.

Figure 8:
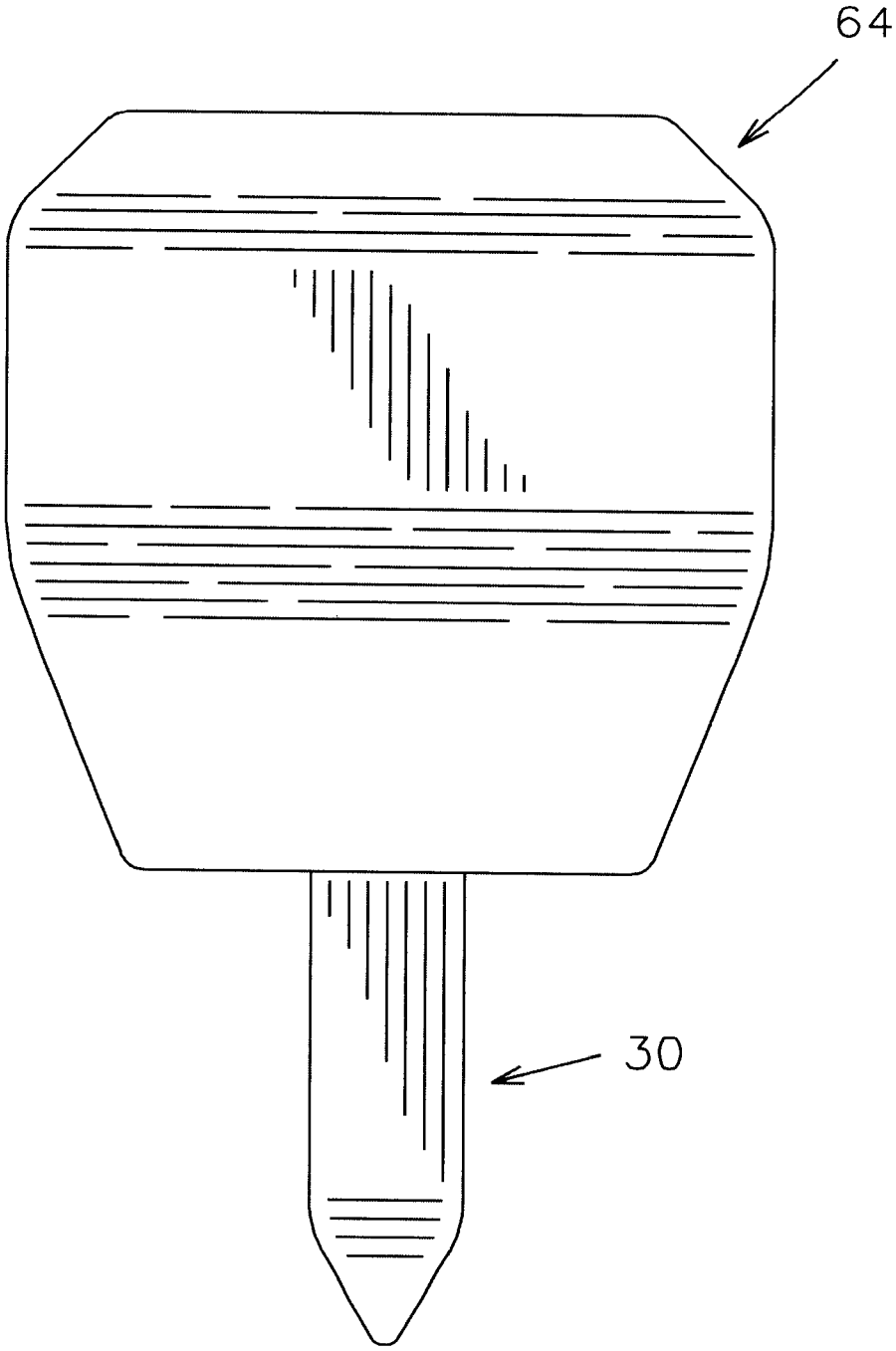
FIG. 8 is a front view of yet another embodiment of the dimpler tools.

In another embodiment 64, a dimpler attachment may be integrally formed as part of the handle member (FIG. 8). Therefore, the diddler tool according to this embodiment is a single piece tool, preferably constructed of a rigid plastic material.

Figure 9:
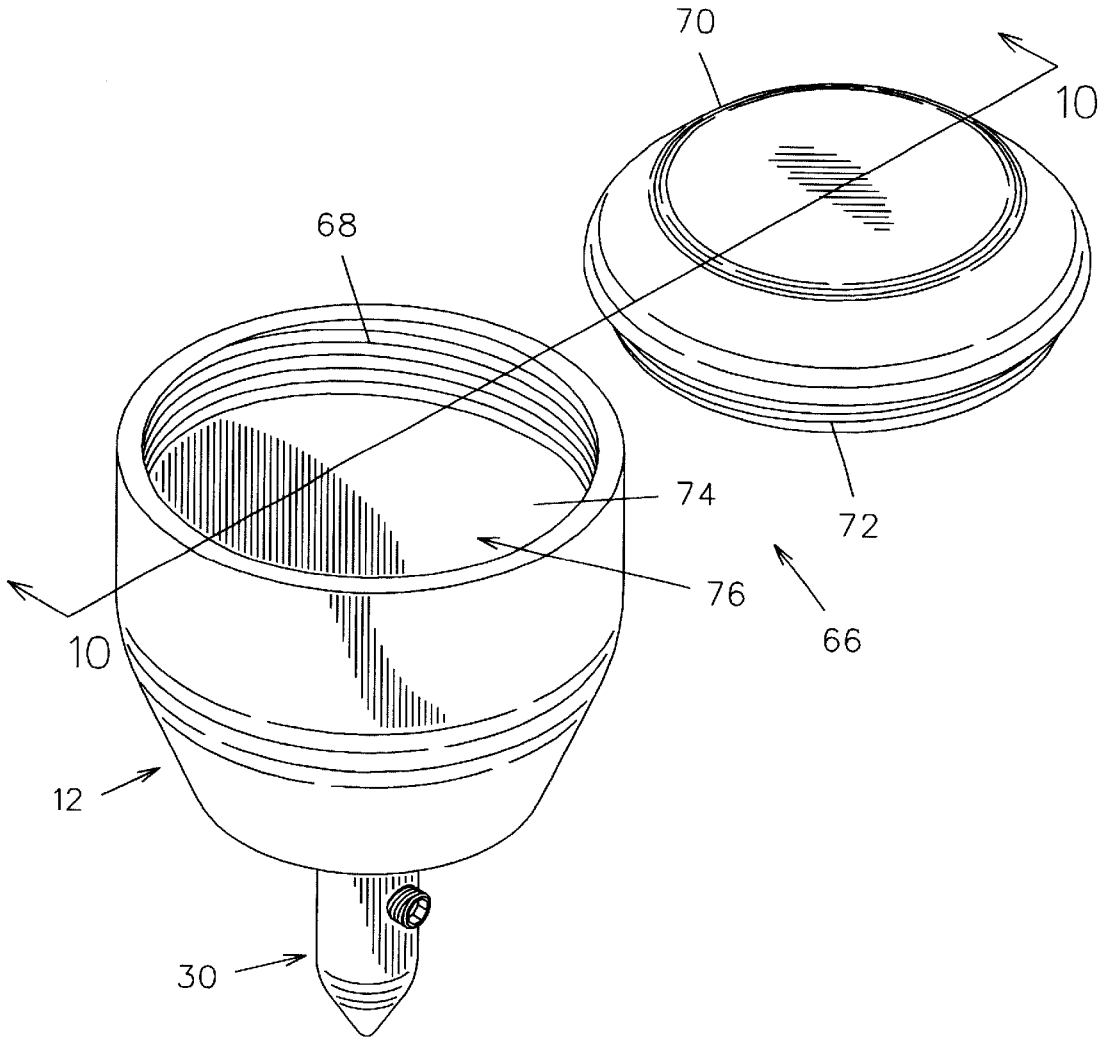
FIG. 9 is an exploded perspective view of yet another embodiment of the dimpler tool.
Figure 10:
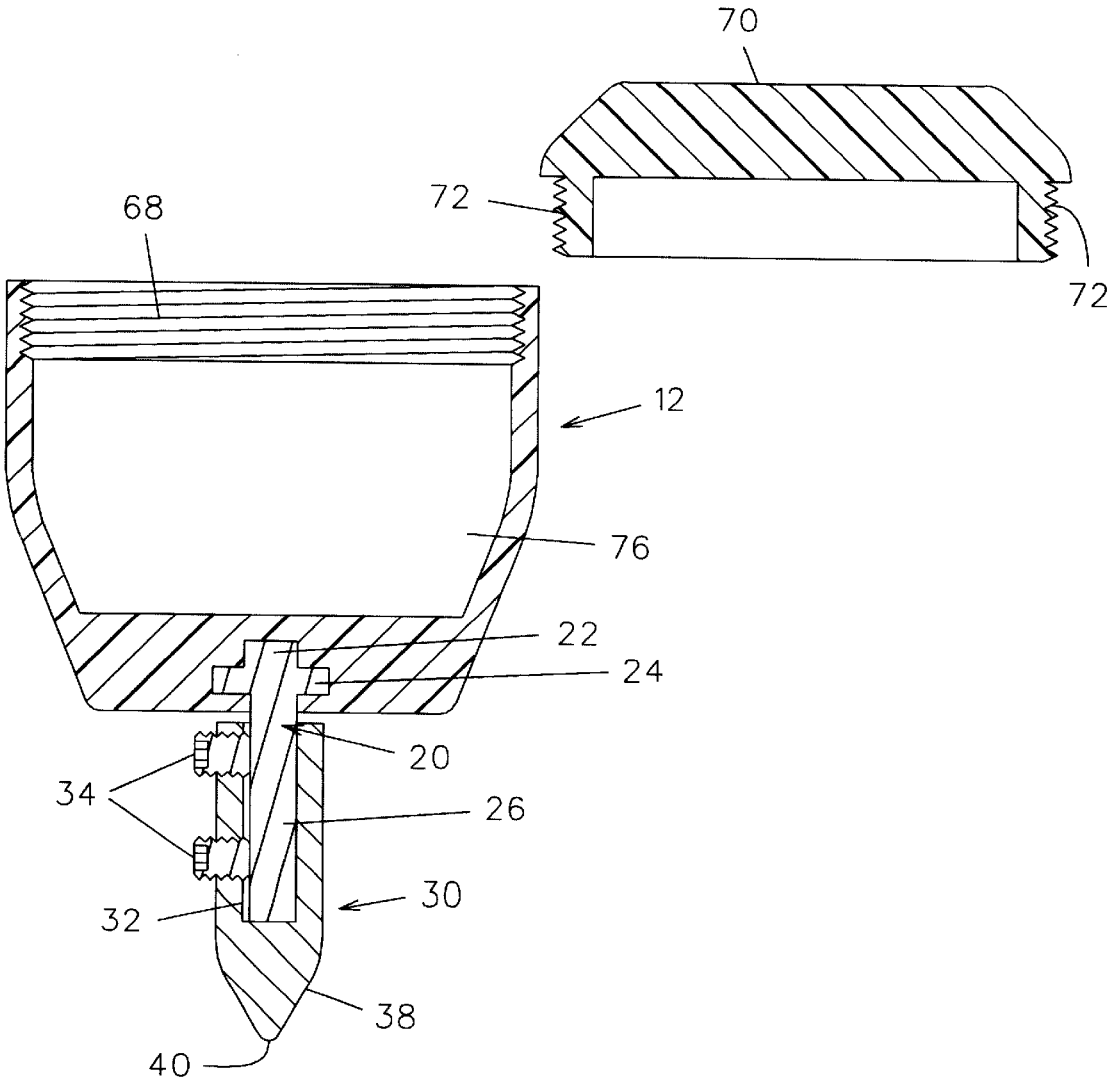
FIG. 10 is a sectional view taken along line 10—10 of FIG. 9.

In yet another embodiment 66, the handle member 12 includes an open top 74 and defines a hollow chamber 76 between a closed bottom and the open top 74 (FIG. 9). An upper portion 68 of the interior surface of the chamber 76 is threaded. This embodiment of the dimpler tool includes a lid 70 having threads 72 complementary to the threaded portion 68 of the interior chamber surface such that the lid may be removably coupled to the handle member 12 to selectively enclose the chamber 76.

In use, a multiplicity of variously sized and configured dimpler attachments and auxiliary attachments may be stored in the chamber 76 when not in use. To repair a hole left over from the removal of a fastener from a wall surface, an appropriately sized dimpler attachment 30 may be removably coupled to the projecting second portion 26 of the shaft 20. The tapered dimpler tip 38 may then be placed within the hole and pressure thereto may be applied to the handle member 12 by a user. The flat top surface of the handle member 12 may even be struck by a user's hand if necessary. This pressure should be applied in conjunction with a rotational movement of the handle member 12 so that torn or frayed sheetrock paper is smoothed within the hole. The dimpler attachment may be removed and returned to the storage chamber 76 following use. An auxiliary attachment having an appropriately configured screwdriver tip may also be coupled to the shaft if desired to screw or unscrew a fastener from a wall or other structure.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A dimpler tool with auxiliary attachments adapted to smooth a wall surface in preparation for spackling following removal of a fastener therefrom, comprising:

a handle member having a side wall, a closed bottom, and an open top defining an interior chamber;

a lid threadably coupled to said handle member and adapted to removably cover said open top, said lid having a flat top having a diameter greater than a diameter of said closed bottom such that said flat top is adapted to be struck by a user's hand;

a shaft having a first portion embedded in said closed bottom of said handle and a second portion projecting from said closed bottom; and a dimpler attachment having a cylindrical configuration and defining a cylindrical interior cavity with an open end, said cavity having a diameter greater than a diameter of said shaft such that said second portion of said shaft may be inserted into said cavity through said open end and removably coupled thereto, said dimpler attachment having a tip that tapers to a point at a free end opposite said open end, said tip having a surface capable of forming a smooth cavity in a wall where a fastener has been removed upon a user rotation of said tip therein.

2. A dimpler tool as in claim 1 wherein said dimpler attachment includes at least one screw adapted to removably fasten said dimpler attachment to said shaft.

3. A dimpler tool as in claim 1 wherein said second portion of said shaft is threaded and said cavity includes threads complementary to said threaded second portion, whereby said dimpler attachment is adapted to be threadably coupled to said second portion of said shaft.

4. A dimpler tool as in claim 1 wherein said dimpler attachment is adapted to snappably engage said second portion of said shaft.

5. A dimpler tool as in claim 1 wherein said side wall of said handle member defines a plurality of recesses disposed radially thereabout, each recess being concave and extending substantially between said closed bottom and said open top.

6. A dimpler tool as in claim 1 further comprising an auxiliary attachment adapted to be removably coupled to said second portion of said shaft when said dimpler attachment is selectively removed therefrom, said auxiliary attachment having a screwdriver tip.

7. A dimpler tool as in claim 1 wherein said handle member is constructed of wood and said shaft and dimpler attachment are constructed of stainless steel.

* * * * *